United States Patent [19]

King et al.

[11] Patent Number: 5,037,072

[45] Date of Patent: Aug. 6, 1991

[54] INJECTION BLOCK AND METHOD

[75] Inventors: Patrick D. King, Rantoul, Ill.; Earl P. Shapland, Sarasota, Fla.

[73] Assignee: Flo-Con Systems, Inc., Champaign, Ill.

[21] Appl. No.: 461,222

[22] Filed: Jan. 5, 1990

Related U.S. Application Data

[63] Continuation-in-part of Ser. No. 53,080, May 22, 1987, Pat. No. 4,771,992, which is a continuation-in-part of Ser. No. 14,999, Feb. 17, 1987, Pat. No. 4,799,649, which is a continuation-in-part of Ser. No. 885,873, Jul. 15, 1986, Pat. No. 4,824,079.

[51] Int. Cl.[5] ..... C21B 7/16

[52] U.S. Cl. ..... 266/268; 266/216; 266/224

[58] Field of Search ..... 266/265, 216, 219, 220, 266/268, 224

[56] References Cited

U.S. PATENT DOCUMENTS

| | | | |
|---|---|---|---|
| 4,575,393 | 3/1986 | Bates et al. | 266/216 |
| 4,771,992 | 9/1988 | King | 266/265 |
| 4,840,356 | 6/1989 | Labate | 266/265 |

FOREIGN PATENT DOCUMENTS

| | | | |
|---|---|---|---|
| 8800246 | 1/1988 | World Int. Prop. O. | 266/265 |

*Primary Examiner*—S. Kastler

*Attorney, Agent, or Firm*—Jack E. Dominik

[57] ABSTRACT

An injection block of an injection valve is disclosed which is normally intended for installation in a metallurgical vessel or holding vessel containing ferrous metal. Other metals can be similarly treated by injection metallurgy, but the maximum utility is believed to be involved in the processing and metallurgical finishing of ferrous metals. The injection block is provided with orifice passages terminating in orifices through which the injections are gas driven, wire fed or in pellet form inserted into the molten metal in the vessel. The orifice passages are angled in one of two directions or a combination of the two directions, radially relative to the axis of the injection block and/or tangentially away from an element that is parallel to the axis of the injection block so as to circumvolve the axis of the injection block. The method of the present invention is directed to a method of injecting material into a liquid metal held within a vessel in such a fashion that they will initially be impelled on an axis which is not along or parallel to the vertical axis of the vessel regardless of the mounting position of the injection mechanism to thereby promote bubble break-up and maximum dispersion of the injection.

11 Claims, 2 Drawing Sheets

INJECTION BLOCK AND METHOD

CROSS-REFERENCE TO RELATED APPLICATIONS

The present application is a continuation-in-part of application Ser. No. 053,080 filed May 22, 1987 and entitled "Multi-Hole Injection Valve and Method" now issued into U.S. Pat. No. 4,771,992 dated Sept. 20, 1988; which in turn is a continuation-in-part of application Ser. No. 014,999 filed Feb. 17, 1987 and entitled "Injection Valve" now issued into U.S. Pat. No. 4,799,649 dated Jan. 24, 1989; which application is a continuation-in-part of Ser. No. 885,873 filed July 15, 1986 and entitled "Injection Valve Components and Method" now issued into U.S. Pat. No. 4,824,079 dated Apr. 25, 1989.

FIELD OF THE INVENTION

The present invention relates to injection valves primarily useful in metallurgical processes in the treating of ferrous metals, and more particularly steel. The general field of invention is exemplified in Bates U.S. Pat. No. 4,575,393 and in addition to that injection valve disclosed in U.S. Pat. No. 4,771,992 issued Sept. 20, 1988 and entitled "Multi-Hole Injection Valve and Method".

SUMMARY OF THE PRIOR ART

The prior art is exemplified in the above-mentioned Bates U.S. Pat. No. 4,575,393 and its own prior art. Injection valves such as the Bates valve are normally side mounted on the vessel which is utilized for teeming metal. The metal is normally teemed from the bottom. The purpose of the injection valve is to accomplish metallurgical functions in a ladle separate and apart from the active and somewhat corrosive environment of a furnace. Degasifiers, dephosphorizers, as well as additives such as nickel, molybdenum, and chromium can be inserted through injection valves.

Applicant's predecessor valves have all been primarily designed for bottom injection although they have the capability of being side mounted. In any usage of injection valves it is important to inject in such a fashion so that the "bubble" which is formed as the additives are injected with high pressure gas will break up and the solids allowed to react throughout the entirety of the teeming vessel. With a side mounted valve, it is questionable as to whether there is total penetration to the bottom of the vessel without additional stirring beyond that imparted by the injection and the gas under pressure.

Accordingly, it is highly desirable to develop an injection valve which, in the process of injection, imparts a horizontal component of the bubble vector in order to assist in breaking up the bubbles, and more particularly to promote s an homogeneous dispersion of the injection.

SUMMARY OF THE INVENTION

The present invention is directed primarily to the injection block of an injection valve which would normally be intended for bottom injection but may be used for side injection in a teeming vessel or holding vessel containing ferrous metal. Other metals can be similarly treated by injection metallurgy, but the maximum utility is believed to be involved in the processing and metallurgical finishing of ferrous metals. The injection block is provided with a plurality of orifices through which the injected materials are gas driven or wire fed or in pellet form are inserted into the molten metal in the teeming vessel. The axis of the orifice passages or passages leading to the orifices are angled in two directions, radially toward the axis of the injection block and tangentially so as to circumvolve the axis of the injection block. The present invention contemplates the radial orientation without the tangential orientation, the tangential orientation without the radial orientation, and the combination of both radial and tangential orientation of the orifice passages. The method of the present invention is directed to a method of introducing injections under gas pressure into the lower portion of a teeming vessel in such a fashion that they will initially be impelled on an axis which is not parallel to the injection block axis nor perpendicular to the injection device mounting to thereby promote bubble breakup and maximum dispersion of the injected material.

In view of the foregoing, it is a principal object of the present invention to provide an injection block for an injection valve which will introduce the injections in a direction different from the vertical axis of the teeming vessel regardless of the mounting position of the injection device.

A related object of the present invention looks to the method of providing dispersion and bubble break-up by introducing injections with gas under pressure in an orientation other than along or parallel to the vertical axis of the vessel, and in various combinations of radial and tangential canted displacement.

Yet another object of the invention is to provide the above features of bubble break-up and dispersion in an injection block which, because it is frustoconical in configuration, reduces the amount of refractory required to achieve the purpose of injecting through the bottom or wall of a metal teeming vessel.

BRIEF DESCRIPTION OF THE DRAWINGS

Further objects and advantages of the present invention will become apparent as the following description proceeds, taken in conjunction with the accompanying drawings, in which.

DESCRIPTION OF A PREFERRED EMBODIMENT

Figures 1, 2:
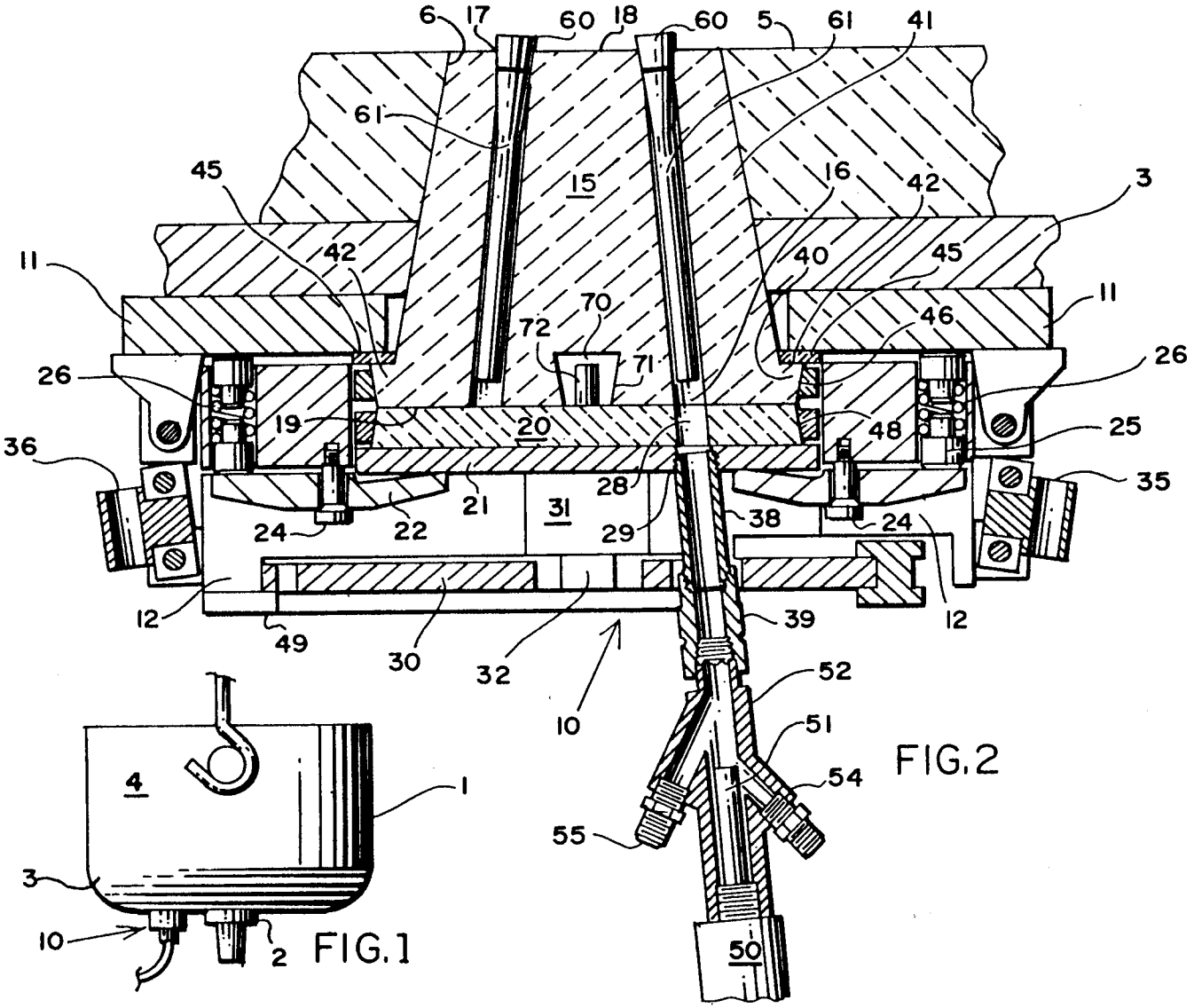
FIG. 1 is a front elevation, partially diagrammatic, showing a ladle which has a sliding gate valve for teeming as well as an injection valve illustrative of the present
FIG. 2 is a transverse sectional view of the injection valve shown in FIG. 1 illustrating its various components.

For purposes of background, there is shown in FIG. 1 a ladle 1, having at its bottom portion a sliding gate teeming valve 2, which is secured to the ladle bottom 3.

An injection valve illustrative of the present invention is indicated by the reference numeral 10 in FIG. 1 and though it is shown mounted to the ladle bottom 3 might alternatively be mounted to the ladle wall 4.

As shown in FIG. 2, the injection valve 10 is mounted to the vessel or ladle 1 by being secured to the ladle bottom 3, and penetrating the ladle refractory lining 5 through an opening 6. A mounting plate 11 is provided at the upper portion of the injection valve 10 to be bolted or otherwise secured to the ladle bottom 3. A mainframe 12 is connected to and extends downward from the mounting plate 11 and holds the various elements of the injection valve 10.

Figure 3:
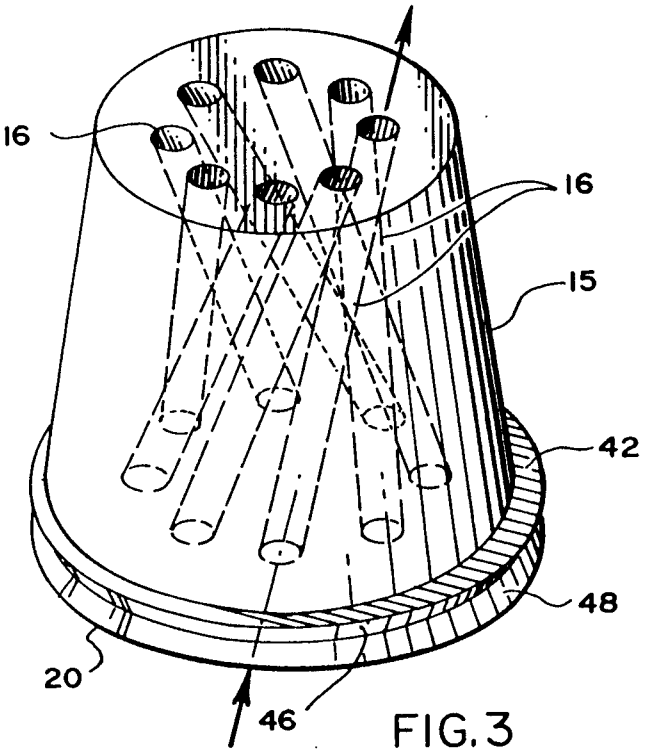
FIG. 3 is a perspective partially diagrammatic view of the subject injection block illustrating the angularity of the injection orifice passages, and diagrammatically the path of the injection once introduced into the vessel.

Central to the construction of the injection valve is the injection block 15 which is sealed to the ladle refractory lining 5 within the opening 6. The injection block 15 remains stationary during operation of the injection valve. To this end, the injection block may be elliptical or some shape other than circular in lateral cross-section to secure it against rotation inside the opening 6 and the opening 6 is complementary shaped to receive and lockingly engage the injection block 15. With in the injection block 15 are a plurality of injection orifice passages 16. The injection orifice passages 16 extend from the injection block outer face 19 through the injection block 15 to the injection block orifices 17 which are located in the wet face 18 of the injection block 15. As shown in FIG. 3, these injection orifices and their corresponding orifice passages are essentially oriented on a circle surrounding the axis of the injection block.

Also central to the injection valve is an injection slide plate 20 mounted on top of a slide plate carrier 21. The injection slide plate 20 is preferably elliptical or other non-circular shape in lateral cross-section along with the complemental means for mounting the same to the slide plate carrier 21 which will be described hereinafter.

In order to maintain the injection slide plate 20 in a pressure face-to-face sealing relationship with the outer face 19 of the injection block 15, a plurality of rocker arms 22 are provided to yieldably engage the slide pate carrier 21. The rocker arms are oriented radially around the slide plate carrier 21. Again as shown in FIG. 2, each rocker arm 22 is pivotally secured to the main frame 12 by a rocker arm bolt 24. One end of the rocker arm is engaged by spring pad 25 which, in turn, is urged by spring 26 to thereby pivot the rocker arm 22 and urge its opposite end to press against the slide plate carrier 21.

The injection slide plate 20 is provided with at least one orifice 28. A carrier pipe connector 38 that is secured to the slide plate carrier 21 in an orifice 29 extends through the drive plate 30 and is terminated with an inlet coupling 39. The slide plate carrier orifice 29 is designed to orientate the carrier pipe connector 38 and inlet coupling 39 beyond the injection slide plate 20 and in line with the orifice passages 16. Additional slide plate orifices 28, slide plate carrier orifices 29, inlet pipes 38 and inlet couplings 39 may be provided.

The rotating portion of the mechanism is driven by the drive plate 30, which acts through drive hub 31 having a hexagonal head 32 secured in the drive plate 30. The hub 31 connects directly into the slide plate carrier 21.

The mounting plate 11 of the injection valve 10 has a latch toggle 35, and an opposed hinge toggle 36 which acting together secure the main frame 12 to the mounting plate 11. By releasing the latch toggle and hinging the frame on the hinge toggle the injection valve 10 maybe opened up for servicing or replacing the injection block 15 and/or the slide plate 20, and other elements of the construction.

Turning again to FIG. 2, it will be seen in greater detail that the carrier pipe connector 38 which connects to the slide plate carrier 21 and extends through the drive plate 30 includes an inlet coupling 39. As noted also in FIG. 2, the injection block 15 includes an injection block collar 40 which is preferably elliptical or other non-circular shaped in lateral cross-section, an injection block collar shoulder 42. The injection block collar shoulder 42 is engaged, as shown in FIG. 2, by a backing ring 45. A clamping ring 46 is provided for the injection block collar 40, and complementary shaped to the injection block collar 40. It thereby secures the injection block 15 in a non-rotating manner to the backing ring 45 which in turn engages the mounting plate 11. A similar clamp ring 48 is provided for the injection slide plate 20. It is similarly secured to the slide plate carrier 21. The drive plate retainer 49 as shown in FIG. 2 is attached to the main frame 12 and secures the drive plate 30.

When it is time to begin ladle metallurgy, the punch-out cylinder 50 is activated and its punch-out rod 51 extends through the multi-media connector body 52. The multi-media connector body 52 has a fluidized media port 54 and a wire port 55. The wire port 55 is upstream from the fluidized media port so that any wire injected is unrestricted and uninhibited by the interior elements contained in the multi-media connector body 52. Fluidized media may include any substances, gaseous, liquid, powdered or particulate which can be suspended in a fluid. Wire media can include solid wire of a particular metallurgy or cored wire containing liquid, powdered or particulate material.

The purpose of the punch-out rod 51 is to engage the orifice plug shaft portion 61 and force the orifice plug 60 together with the orifice plug shaft portion 61 out of the injection block 15 and thus open the injection path between the multi-media connector body 52 and the interior of the vessel 1. Shown in prior application Ser. No. 053,080, now U.S. Pat. No. 4,771,992, are the specifics of the drive plate.

After injection has been completed, the vessel emptied, and the assembly is opened, the injection block 15 can be removed by engaging its puller 70 shown adjacent to the slide face of the injection block in FIG. 2. The puller 70 may be an insert shaped to mechanically engage the injection block molded into the injection block or may be a connector molded integral in the injection block 15. As illustrated it is an insert molded into the injection block having an internal thread for connection of a pulling device which is not shown. This provides a means to pull the injection block 15 out of the opening 6 in the ladle lining for replacement, or otherwise servicing.

Figure 4:
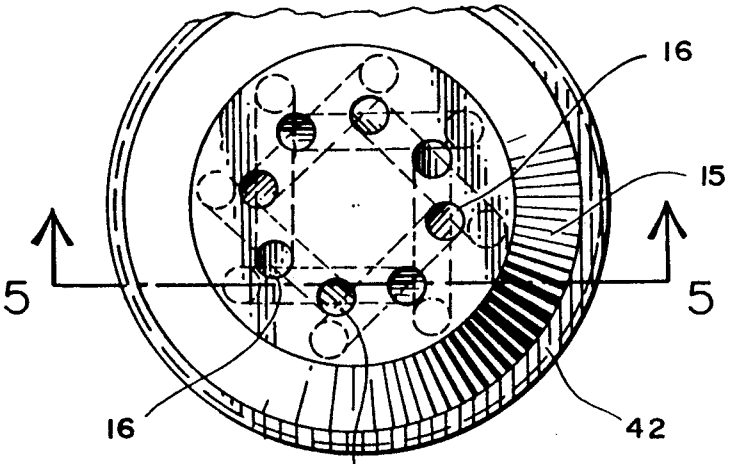
FIG. 4 is a top view of the injection block shown in FIG. 3, but partially broken to illustrate the relationship between various ones of the injection orifice passages.

The thrust of the invention is best illustrated in FIGS. 2 and 3 where it will be seen that the axis of each of the injection orifice passages 16 may be angled radially toward or away from the axis of the injection block 15 as shown in FIG. 2 and may be also angled tangentially relative to an element parallel to the axis of the injection block so as to circumvolve the axis of the injection block. The injection orifice passages may be angled radially only, tangentially only, or in a combination of radially and tangentially. It is possible to radially angle the axis of each of the injection orifice passages 16 and its associated injection apparatus to as much as 15° toward the axis of the injection block. The axis of the injection orifice passages 16 may be tangentially angled as much as 20° to 160° relative to an element parallel to the axis of the injection block. As shown in FIG. 4 with this degree of angling, the wet face orifice of each injection orifice passage will overlap the seal face entrance position of two adjacent injection orifice passages.

The angle to which the injection orifice passages are canted radially and tangentially is limited by the requirement of having sufficient material in the space between passages and between the passages and the frustoconical sidewall 41 of the injection block as well as between injection block orifices 17 in the wet face 18.

Figure 5:
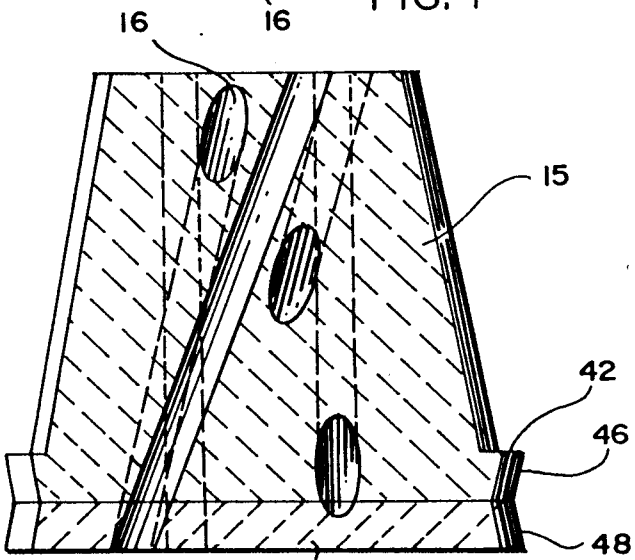
FIG. 5 is a sectional view taken along section line 5—5 of FIG. 4 and illustrating the path of a single injection orifice passage and the orientation of other injection orifice passages.

The method of the present invention is directed entirely to the method of achieving injection of the injected material and the propelling gas at an angle to the vertical axis of the ladle or containing vessel regardless of the mounting location of the injection device. The method looks to the orientation of the injection passages at a radial angle to the axis of the injection device and/or at a tangential angle to an element parallel to the axis of the injection device to provide a circumvolving flow about the axis of the injection device in order to assure the maximum diversion from the vertical axis of the ladle or containing vessel regardless of the mounting position of the injection device. Therefore, the angularity is achieved as shown in FIG. 2 where it is radial toward the axis of the injection device in a frustoconical orientation of the various orifices. A second version is shown in FIGS. 3, 4 and 5 where the angularity is not only achieved radially toward the axis of the injection device but also tangentially so as to circumvolve the axis of the injection device. It is also contemplated that lesser and greater angularity can be utilized.

Although particular embodiments of the invention have been shown and described in full here, there is no intention to thereby limit the invention to the details of such embodiments. On the contrary, the invention is to cover all modifications, alternatives, embodiments, usages and equivalents as fall within the spirit and scope of the present invention, specification, and appended claims.

What is claimed is:

1. An injection block for use with an injection valve, said block comprising a frustoconical refractory member having opposed end portions,
one of said end portions being a wetted portion and the opposite end portion being a seal face,
the smaller of said end portions being the wetted portions,
said block having at least one or more orifices and corresponding size orifice passages leading to these orifices passing from one end portion to another end portion,
each orifice passage angling centrally toward the wetted end portion,
each orifice passage having an axis which is an uninterrupted straight line from the orifices at each end of the block.

2. In the injection block of claim 1 above,
said orifice passages being angled radially toward the axis of the injection block.

3. In the injection block of claim 1 above,
said orifice passages being angled radially toward the axis of the injection block at least 5°.

4. In the injection block of claim 1 above,
said orifice passages being angled tangentially relative to an element parallel to the axis of said block so that the axis of the passage circumvolves the axis of said block.

5. In the injection block of claim 1 above,
said orifice passages being angled tangentially relative to an element parallel to the axis of said block more than 15° but less than 180° so that the axis of the passage circumvolves the axis of said block.

6. In the injection block of claim 1 above,
said orifice passages being angled radially toward the axis of said block and also angled tangentially relative to an element parallel to the axis of said block so that the axis of said passage circumvolves the axis of said block.

7. An injection block for use with an injection valve, said block being made of a refractory material and having two opposed outer portions and an axis,
one outer portion being a wetted face and one a sealing face, the wetted face being the smaller face,
said block having means at one outer portion for engaging a sliding injection plate and an injection mechanism,
said block having at least one or more orifices and corresponding orifice passages of the same size as the orifices leading to these orifices which passages connect orifices on the opposed outer portions,
each orifice passage angling centrally with respect to the axis of said refractory injection block in the direction of the wetted face,
each orifice passage having an essentially straight line tubular section between the orifices at its remote ends.

8. In the injection block of claim 7 above,
said orifice passages being angled radially relative to the axis of the injection block at least 5°.

9. In the injection block of claim 7 above,
said orifice passages being angled tangentially relative to an element parallel to the axis of said block so that the axis of the passage circumvolves the axis of said block.

10. In the injection block of claim 7 above,
said orifice passages being angled tangentially relative to an element parallel to the axis of said block more than 15° but less than 180° so that the axis of the passage circumvolves the axis of said block.

11. In the injection block of claim 7 above,
said orifice passages being angled radially relative to the axis of said block and also angled tangentially relative to an element parallel to the axis of said block so that the axis of said passage circumvolves the axis of said block.

* * * * *